US010221754B2

(12) United States Patent
Madurai Kumar et al.

(10) Patent No.: US 10,221,754 B2
(45) Date of Patent: Mar. 5, 2019

(54) ELECTRICALLY DRIVEN COOLING SYSTEM FOR VEHICULAR APPLICATIONS

(71) Applicant: Cummins Inc., Columbus, IN (US)

(72) Inventors: Mahesh Madurai Kumar, Columbus, IN (US); Gary L. Parker, Columbus, IN (US); Martin T. Books, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/352,243

(22) Filed: Nov. 15, 2016

(65) Prior Publication Data

US 2017/0058755 A1 Mar. 2, 2017

Related U.S. Application Data

(63) Continuation of application No. PCT/US2015/032201, filed on May 22, 2015.

(60) Provisional application No. 62/001,833, filed on May 22, 2014.

(51) Int. Cl.

| | |
|---|---|
| ***F01P 7/16*** | (2006.01) |
| ***F01P 7/04*** | (2006.01) |
| *F01P 5/12* | (2006.01) |

(52) U.S. Cl.

CPC ..... *F01P 7/164* (2013.01); *F01P 7/04* (2013.01); *F01P 7/048* (2013.01); *F01P 2005/125* (2013.01); *F01P 2050/24* (2013.01)

(58) Field of Classification Search

CPC ..... F01P 7/164; F01P 2025/66; F01P 3/20; F01P 2031/30; F01P 7/048; F01P 2005/105

See application file for complete search history.

(56) References Cited

U.S. PATENT DOCUMENTS

| | | | | |
|---|---|---|---|---|
| 6,016,774 | A * | 1/2000 | Bokkers | F01P 5/06 123/41.1 |
| 6,425,353 | B1 * | 7/2002 | Davies | F01P 5/10 123/41.44 |
| 6,450,275 | B1 | 9/2002 | Gabriel et al. | |
| 6,651,761 | B1 | 11/2003 | Hrovat et al. | |
| 7,069,880 | B2 | 7/2006 | Hutchins | |
| 7,451,808 | B2 | 11/2008 | Busse et al. | |
| 7,455,136 | B2 | 11/2008 | Pleune et al. | |
| 7,616,443 | B2 | 11/2009 | Walter | |

(Continued)

OTHER PUBLICATIONS

International Search Report and Written Opinion, PCT/US2015/032201, Aug. 18, 2015, Cummins Inc., 11 pgs.

*Primary Examiner* — Long T Tran

(74) *Attorney, Agent, or Firm* — Taft Stettinius & Hollister LLP

(57) ABSTRACT

Some exemplary embodiments include an electrically driven cooling system for cooling non-engine components of a vehicle. The electrically driven cooling system includes a closed loop coolant flowpath including an electrically driven coolant pump and a radiator connected to the closed loop coolant flowpath, and one or more components connected in parallel and/or in series in the closed loop coolant flow path that receives the coolant. An electrically driven radiator fan is also operable to cool the coolant in the radiator. The electrically driven cooling system is flow isolated from any mechanically driven cooling system that provides coolant to the engine for vehicles that include an engine.

18 Claims, 3 Drawing Sheets

(56) References Cited

U.S. PATENT DOCUMENTS

| | | | | |
|---|---|---|---|---|
| 8,082,889 | B2 * | 12/2011 | Otterstrom | F02B 47/02 123/2 |
| 8,499,869 | B2 | 8/2013 | Cimatti et al. | |
| 8,666,583 | B2 * | 3/2014 | Tashiro | B60H 1/00735 180/65.28 |
| 8,733,299 | B2 * | 5/2014 | Cregut | B60K 1/00 123/2 |
| 8,919,471 | B2 * | 12/2014 | Oberti | B60K 1/00 180/68.4 |
| 2005/0028756 | A1 | 2/2005 | Sautanam et al. | |
| 2006/0185626 | A1 | 8/2006 | Allen et al. | |
| 2009/0013705 | A1 * | 1/2009 | Nishikawa | B60H 1/00 62/239 |
| 2009/0031749 | A1 * | 2/2009 | Nishikawa | B60H 1/00921 62/324.3 |
| 2009/0078220 | A1 | 3/2009 | Meyer et al. | |
| 2010/0236502 | A1 | 9/2010 | Watanabe et al. | |
| 2012/0152186 | A1 | 6/2012 | Sujan et al. | |
| 2012/0173063 | A1 | 7/2012 | Madurai Kumar et al. | |
| 2012/0247753 | A1 | 10/2012 | Bachmann | |
| 2013/0056194 | A1 * | 3/2013 | Cregut | B60K 11/02 165/300 |
| 2013/0211649 | A1 * | 8/2013 | Tashiro | B60H 1/00735 701/22 |

* cited by examiner

ELECTRICALLY DRIVEN COOLING SYSTEM FOR VEHICULAR APPLICATIONS

CROSS-REFERENCE TO RELATED APPLICATION

The present application is a continuation of International Patent Application No. PCT/US2015/032201 filed May 22, 2015, which claims the benefit of the filing date of U.S. Provisional App. Ser. No. 62/001,833 filed on May 22, 2014, each of which is incorporated herein by reference in its entirety.

BACKGROUND

Vehicles conventionally use a mechanically driven coolant pump that is integrated with the engine to cool the engine and other sub-systems on the vehicle. These mechanically driven coolant pumps are typically tied to the engine speed by a gear ratio so that when the engine is running the coolant flow is greater at higher speeds than when the engine is at lower speeds. In addition, no coolant flow is provided when the engine is shut down.

For certain vehicles, components other than the engine are connected to the coolant system so that the coolant flow also provides cooling of these components. These components retain heat when the engine is shut down and thus are subject to various heat related conditions, such as heat soak, thermal meltdowns, and reduced durability.

There is also increased use of electrified systems on vehicles. One example is a typical hybrid electric vehicle (HEV) which includes an engine and a number of electric components like electric generators, electric motors, power electronics like DC/AC inverters, DC/DC converters, and energy storage technologies like super capacitors and/or batteries. Other vehicles may employ an on-board generating system that includes electric generators and power electronics like DC/AC inverters and/or DC/DC converters. There are several other examples of vehicles that employ electric accessories including the motors and power electronics to drive the accessories. Also, there are completely electrified vehicles like battery electric vehicles (BEV) or fuel cell vehicles (FCV) that do not have any engine cooling loop available to cool any of their components.

Such electrified systems and other components of the vehicle have substantially different cooling needs than the engine (if provided), and the mechanically driven coolant system often struggles to satisfy these needs. For example, electric components have different cooling requirements such as different temperature thresholds and coolant flow rates than the engine and even different requirements among one another, and may be required to operate when the engine is shut down. Mechanical components such as air compressors, exhaust gas recirculation valves, and turbochargers also have cooling requirements that differ from the cooling requirements of the engine, and also often have to operate when the engine is shut down, or retain heat after the engine is shut down. Therefore, further improvements are needed to enable non-engine components of vehicles to operate at higher efficiencies, improve performance, and/or improve the operating life and durability.

SUMMARY

There is disclosed herein an electrically driven cooling system for cooling of non-engine components of a vehicle with or without an engine, where the electrically driven cooling system is operable to provide the desired temperature and coolant flow rates for the non-engine components to operate more efficiently and at greater performance levels than can be obtained with a mechanically driven coolant system operated by the engine. The electrically driven cooling system may include an electrically driven coolant pump to circulate coolant through all the non-engine components that require coolant flow and an electrically driven radiator fan that can reject the heat from the coolant to the atmosphere. The electrically driven cooling system can be driven by low voltage or high voltage electrical system depending on the overall system design.

The electrically driven cooling system provides cooling of non-engine components that retain heat and/or operate after the engine is shutdown to reduce thermal meltdowns, heat soak, and improve durability and operating life of the components. Example non-engine components includes electric generators, motors, energy sources such as super capacitors and batteries, power electronics, AC/DC inverters, DC/DC converters, air compressors, valves, turbochargers, and engine subsystems. As used herein, a non-engine component or components includes any part of the vehicle that is not an engine.

The electrically driven coolant pump and electrically driven radiator fan of the electrically driven cooling system can be operated by power from a power source, such as a generator and/or energy storage device, independently of engine speed, and the coolant and air flow rate in the electrically driven cooling system can be completely controlled independently of the engine cooling system to, for example, provide higher flows to reject more heat from one or more of the non-engine components during heat rejection conditions. In contrast, mechanically driven cooling systems driven or powered by the engine require the coolant and air flow rate to be proportional to engine speed. The electrically driven cooling system can continue to operate even when the engine is shutdown, so any non-engine component in the electrically driven cooling system can continue to be cooled, reducing risks of thermal soaks and improving durability and operating life of the components.

The power consumption of the electrically driven cooling system can be minimized by optimally operating the electrically driven coolant pump and/or the electrically driven radiator fan based on heat rejection, power availability, ambient conditions, or other suitable parameter or parameters associated with the non-engine components and not tied to engine operation. The electrically driven cooling system allows for flexibility in the placement of components that are to be cooled in series, in parallel, or in series and parallel combinations to achieve flow balance and minimize pressure drops. Additional non-engine components can be readily added to the coolant loop, and the same coolant flow rate can be maintained by increasing the speed of the electrically driven coolant pump.

The electrically driven cooling system can by employed in vehicles that do not have an engine, and hence lack an engine cooling loop, like BEV or FCV, or in vehicles that include an engine and a separate cooling system for the engine operated by a mechanically driven coolant pump. If the vehicle is configured to capture any braking energy via regenerative braking using an electric generator, the electrically driven cooling system can be employed to store the braking energy that is captured. The free braking energy that is captured can be used to power the electrically driven coolant pump and/or electrically driven radiator fan by using the power to turn it ON when the electrically driven coolant pump is OFF, or using the power to keep electrically driven coolant pump in the current state if it is already ON. Free energy captured from regenerative braking can also be used to increase the cooling capability of the electrically driven cooling system by increasing the speed of the electrically driven coolant pump and/or electrically driven radiator fan from its current state to achieve free cooling. This pre-cooling can reduce the need for the electrically driven cooling system to operate at a later stage when it has to use stored energy and free energy is not available, thereby helping to improve the vehicle's fuel economy.

Some exemplary embodiments include an electrically driven cooling system for a vehicle comprising a closed loop coolant flowpath including an electrically driven coolant pump operable to direct coolant flow to a plurality of components of the vehicle and to a radiator, the system further including an electrically driven radiator fan. In certain embodiments the vehicle includes a separate mechanically driven cooling system with a closed loop coolant flowpath and a mechanically driven coolant pump operable to direct coolant flow to an internal combustion engine and to a second radiator. The coolant in the mechanically driven cooling system is flow isolated from the coolant in the electrically driven cooling system. Some exemplary embodiments include methods of operation and/or control of electrically driven cooling systems for a vehicle. Further embodiments, forms, objects, features, advantages, aspects, and benefits shall become apparent from the following description and drawings.

DETAILED DESCRIPTION

For purposes of promoting an understanding of the principles of the invention, reference will now be made to the exemplary embodiments illustrated in the figures and specific language will be used to describe the same. It will nevertheless be understood that no limitation of the scope of the invention is thereby created, and that the invention includes and protects such alterations and modifications to the illustrated embodiments, and such further applications of the principles of the invention illustrated therein as would occur to one skilled in the art to which the invention relates.

Figure 1:
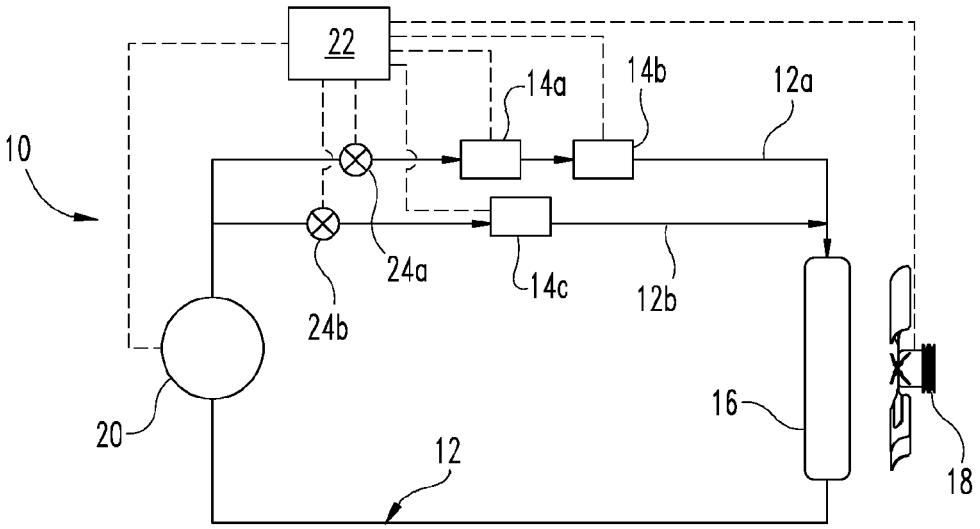
FIG. 1 is a schematic diagram illustrating an exemplary electrically driven cooling system for a vehicle.

FIG. 1 illustrates an electrically driven coolant system 10 for a vehicle including a closed loop coolant flowpath 12 which is in thermal communication with a number of non-engine components 14*a*, 14*b*, 14*c* (collectively referred to as components 14) and is operable to provide heat transfer between those components and the coolant. In exemplary embodiments thermal communication is provided by a coolant flowpath 14 passing through one or more flow passages provided in one or more of components 14 or a housing of one or more components 14. In further exemplary embodiments thermal communication is provided by coolant flowpath 14 passing through a separate structure in contact with one or more components 14 or its housing. In further exemplary embodiments thermal communication is provided by a heat transfer device intermediate the coolant flowpath 14 and one or more of the components 14 and/or their housings. Coolant flowpath 14 is a closed loop flowpath in one embodiment and may include one or more vents, bleed valves, ports or safety valves, but additional embodiments may also include other types of coolant flowpaths.

Electrically driven cooling system 10 further includes a radiator 16 and an electrically driven radiator fan 18 which are operable to selectably transfer heat from coolant flowing through cooling system 10 to ambient. Electrically driven cooling system 10 further includes one or more electrically driven coolant pumps 20 operable to circulate coolant through coolant flowpath 12, components 14, and radiator 18.

Electrically driven coolant system 10 also includes a controller 22 which is coupled to and operable to control the operation of electrically driven coolant pump 20 and electrically driven radiator fan 18 and components 14, as well as to receive information from such components 14 or from sensors provided therewith and/or associated with the coolant. Controller 22 is provided to receive data as input from various sensors, and send command signals as output to various actuators. Some of the various sensors and actuators that may be employed are described in detail below. The controller 22 can include a processor, a memory, a clock, and an input/output (I/O) interface. In certain embodiments, controller 22 is structured to perform certain operations to control electrically driven cooling system 10 in achieving one or more target conditions. In certain embodiments, the controller forms a portion of a processing subsystem including one or more computing devices having memory, processing, and communication hardware. The controller may be a single device or a distributed device, and the functions of the controller 22 may be performed by hardware and/or instructions for algorithms that are provided on non-transient computer readable storage media.

Electrically driven coolant pump 20 is driven by electrical power from an electrical energy system of the vehicle and is operatively connected to controller 22 which controls its operation. The electrically energy system can be a high voltage system or a low voltage system. In certain operating modes of the vehicle, electrically driven cooling system 10 may pump coolant through coolant flowpath 14 using electrically driven coolant pump 20 to provide cooling of components 14. In other operating modes of the vehicle, electrically driven cooling system 10 may not pump coolant through coolant flowpath 14, or through one or more selected portions of the coolant flowpath 14.

Certain exemplary embodiments including an electrically driven coolant pump may allow the power consumption of the electrically driven coolant pump 20 to be minimized by optimally operating the electrically driven coolant pump 20 to selectively provide cooling to one or more of components 14 based on cooling needs, heat rejection rates, power availability, and ambient conditions, for example. In a further embodiment, coolant flowpath 12 can include separate flowpath portions 12*a*, 12*b* for different types of components 14 where components having similar cooling requirements, such as similar flow rates, heat rejection rates, and operating requirements, are grouped in a common flow path. For example, components 14*a*, 14*b* can be provided in first flowpath portion 12*a* and component 14*c* can be provided in second flowpath portion 12*b*. Each flowpath portions 12*a*, 12*b* can include a controllable valve 24*a*, 24*b* operatively connected to controller 22 that are operable to selectably direct coolant flow through flowpath portion 12*a*, 12*b*, respectively, in response to a temperature condition of one or more of components 14. In certain embodiments a single valve such as a three-way valve may be operatively connected to controller 22 and operable to selectably direct coolant flow through one or both of flowpath portions 12*a*, 12*b*.

Radiator 16 is operable to transfer heat from coolant flowing therethrough to the ambient environment and an electrically driven radiator fan 18 operatively connected to controller 22 that is controllable to increase or decrease the rate of heat transfer by controllably directing ambient air across radiator 16. Radiator 16 is common to and provides heat transfer to ambient for all components 14 which transfer heat to coolant flowing through coolant flowpath 12.

In an embodiment of system 10 that lacks an engine for powering the vehicle, components 14 can include, for example, any one or combination of a motor/generator, an inverter, a clutch, and a DC/DC converter, a DC/AC inverter, an energy source such as a battery or super capacitors, and power electronic. It shall be understood that additional and alternate components which produce heat and require cooling may also be present in addition to or instead of the illustrated and specifically identified components. As illustrated in FIG. 1 components 14*a* and 14*b* are positioned in series with one another and in parallel with component 14*c* in closed loop coolant flowpath 12. Additional embodiments contemplate other locations for components 14 relative to one another and relative to the other components of electrically driven cooling system 10 including, for example, series flow relationships, parallel flow relationships, and combinations of series and parallel flow relationships of various orders.

Figure 2:
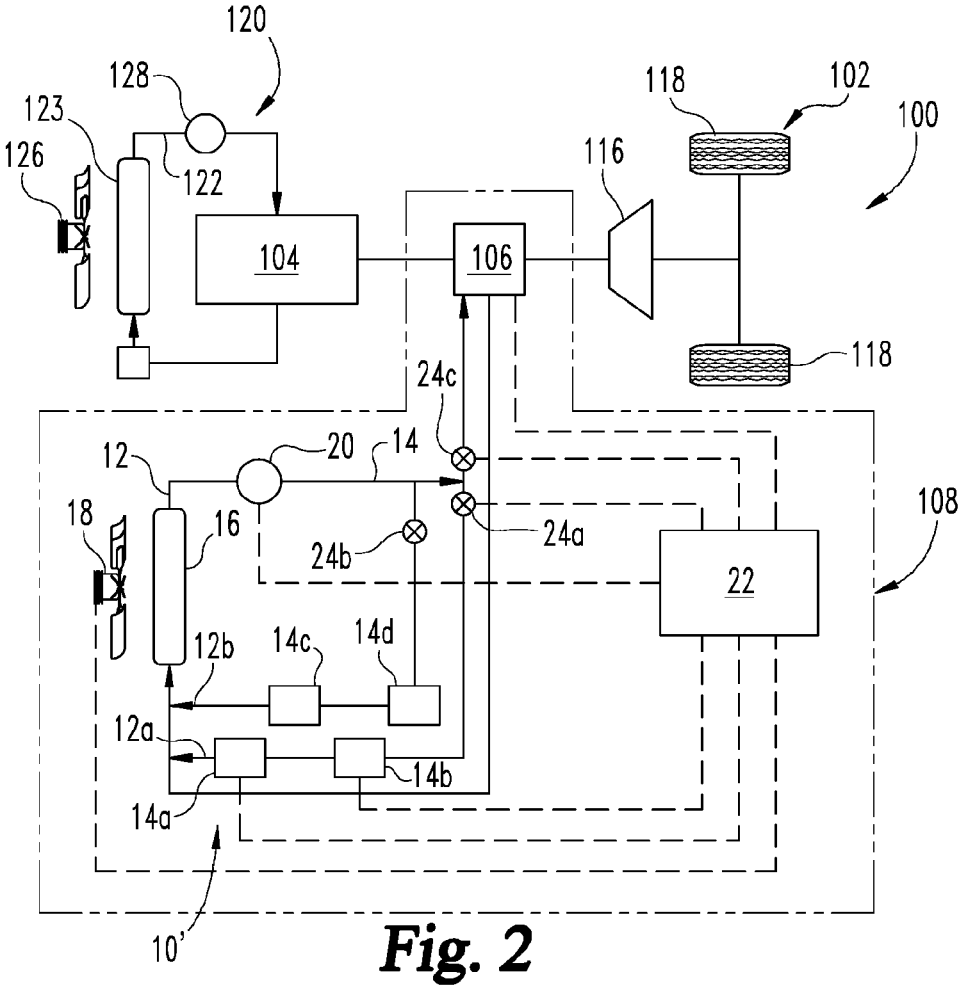
FIG. 2 is a schematic diagram illustrating another exemplary electrically driven cooling system for a vehicle.

FIG. 2 illustrates a cooling system 100 for a vehicle 102 including an internal combustion engine 104 and a motor/generator 106 which are selectably coupled to one another by, for example, a controllable clutch (not shown.) Motor/generator 106 is electrically coupled with an electrical energy system 108 which includes one or more components 14*a*, 14*b* such as energy storage devices and power electronics devices operable to convert electrical power received from motor/generator 106 for storage in a battery and draw power from the battery to drive motor/generator 106. It shall be understood that the battery may include a number of devices, for example, battery banks, battery packs, as well as ultracapacitors, super capacitors, and other energy storage devices. For simplicity, however, the term energy storage device is used to inclusively describe these possibilities. Likewise, the power electronics of the electrical energy system 108 may include one or more busses, inverters, DC/AC inverters, DC/DC converters, and other power electronics operable to distribute or convert electrical power.

In the illustrated embodiment, vehicle 102 may be operated in different vehicle propulsion modes so that engine 104, motor/generator 106, or both engine 104 and motor/generator 106 provide torque to a transmission 116 which, in turn, provides torque to the drive wheels 118 of the vehicle 102. The vehicle 102 may also be operated so that engine 104 drives motor/generator 106 to recharge the energy storage source. The vehicle 102 may further be operated in a regenerative braking mode in which the motor/generator 106 receives torque from the vehicle wheels 118 and generates power to recharge the energy source in a regenerative braking mode of operation. It shall be understood that the powertrain of vehicle 102 is an exemplary configuration and that additional embodiments contemplate other powertrain configurations including, for example, series hybrid powertrain configurations, parallel hybrid powertrain configurations, series-parallel hybrid powertrain configurations, and power-split hybrid configurations. Furthermore, it shall be understood that additional torque transfer devices for example, torque converters, gear splitters, differentials, deep reduction gears, and/or other devices may be included in the torque path between engine 104, motor/generator 106 and vehicle wheels 118 or in other locations. In other embodiments, the electrical power system 108 is not operable to power a motor-generator that propels vehicle 102, but rather vehicle 102 is propelled exclusively by engine 104.

Cooling system 100 includes a mechanically driven cooling system 120 including a coolant flowpath 122 which is in thermal communication with internal combustion engine 104. In exemplary embodiments thermal communication is provided by a coolant flowpath passing through one or more flow passages provided in engine 104. Mechanically driven cooling system 120 further includes a second radiator 123, a thermostat 124, and a fan 126 which are operable to selectably transfer heat from coolant flowing through mechanically driven cooling system 120 to ambient. Mechanically driven cooling system 120 further includes one or more mechanically driven coolant pumps 128 that are driven mechanically by operation of engine 104.

Cooling system 100 further includes an electrically driven cooling system 10' that can be similar to electrically driven cooling system 10 except as otherwise noted herein, and like components in electrically driven cooling system 10' are identified with the same reference numerals as electrically driven cooling system 10. Electrically driven cooling system 10' similarly includes components 14, but in one embodiment components 14*c* and 14*d* are mechanical components associated with engine 104. For example, components 14*c*, 14*d* can include one or more of a clutch, an air compressor, a turbocharger, an exhaust gas recirculation valve, aftertreatment components, or other non-engine component associated with operation of engine 104 in which cooling is desired and provided by electrically driven cooling system 10' while flow isolated and operable separately from mechanically driven cooling system 120. Such an arrangement allows cooling of components 14 associated with operation of engine 104 even after engine 104 has been shut down and mechanically driven coolant pump is not in operation.

Electrically driven coolant pump 20 is driven by electrical power from electrical power system 108 and is operatively connected to controller 22 which controls its operation. Mechanically driven coolant pump 128 is driven mechanically with torque from engine 104. In certain operating modes, electrically driven cooling system 10' may pump coolant through coolant flowpath 12 using electrically driven coolant pump 20 alone, for example, when engine 104 is shut down. In other operating modes, electrically driven cooling system 10' may pump coolant through coolant flowpath 12 using electrically driven coolant pump 20 alone while mechanically driven cooling system 120 circulates coolant using mechanically driven coolant pump 128 alone, for example, when engine 104 is running. In further operating modes, mechanically driven cooling system 120 circulates coolant using mechanically driven coolant pump 128 alone, for example, when engine 104 is running and electrically driven coolant pump 20 is shut down due to the lack of a cooling requirement along flowpath 14. In addition, flowpath portions 12*a*, 12*b* and 12*c* of coolant flowpath 12 can be hydraulically isolated from one other with controllable valves 24*a*, 24*b*, 24*c*, respectively, so that only the components 14 requiring cooling are provided with coolant flow, reducing power consumption of electrically driven coolant pump 20.

Utilizing multiple operating modes, cooling system 100 is operable to provide coolant flow through closed loop coolant flowpaths 12, 122 during all operating conditions of vehicle 102 including modes where engine 104 on or running and modes where engine 104 is off or shut down. In addition, the coolant in coolant flow path 12 can continue to be circulated to electrical components 14*a*, 14*b* and/or mechanical components 14*c*, 14*d* in response to temperature conditions of these components even when engine 104 is shut down, reducing risks associated with heat soak and improving the operating life and durability of these components. The power consumption of electrically driven cooling system 10' can be optimized based on the heat rejection rate, ambient conditions, coolant flow requirements, power availability and other parameters that are independent of engine operations. Electrically driven cooling system 10' can also be optimized to provide optimal flow rates, variable flow rates depending on cooling requirements of the components 14, flow balance through the flowpath portions 12*a*-12*c*, and/or to minimize pressure drop through the cooling system since the operation of electrically driven coolant pump 20 is independent of the speed of engine 104. Also, additional components 14 can added to cooling systems 10, 10' without affecting operation of the system since flow rates can be readily adjusted by controlling the speed of electrically driven coolant pump 20. Since components other than engine 104 are not cooled by mechanically driven cooling pump 128, mechanically driven coolant pump 128 can be sized smaller due to the reduction in parasitic losses otherwise required by a larger cooling system including components 14.

Valves 24*a*, 24*b*, 24*c* may be actively controlled or may be passive devices, for example, restricted orifices which passively control the flow of coolant to an associated component 14. As illustrated in FIG. 2, components 14 such as motor generator 106 are provided on a separate coolant flowpath portion 12*c* than the energy storage and power electronic components 14*a* and 14*b*, which flowpath portions 12*a* and 12*c* are also on separate coolant flowpaths than the mechanical components, such as 14*c* and 14*d* on flowpath portion 12*b*. Other embodiments contemplate other arrangements and grouping of components on the coolant flowpaths, including each component on a separate coolant flowpath, certain components sharing a coolant flow path, or all components in series. In a further embodiment, the energy storage source is in a parallel coolant flowpath from the power electronics.

Figure 3:
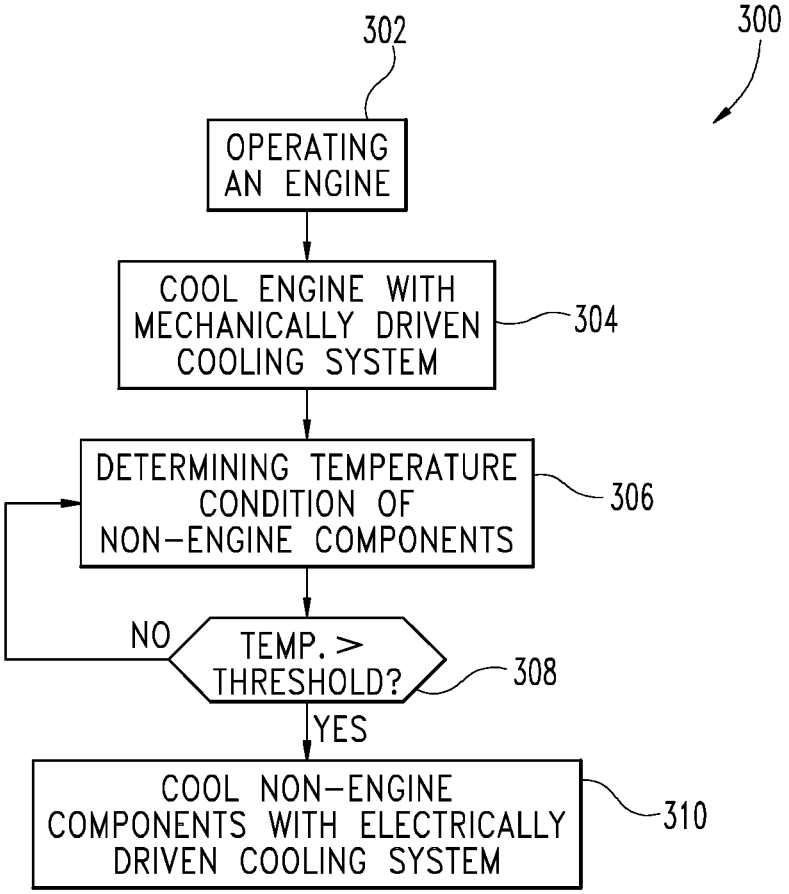
FIG. 3 is a flowchart illustrating an exemplary control procedure for an electrically driven cooling system.

FIG. 3 illustrates an exemplary procedure 300 executable by one or more controllers to control operation of a cooling system for a vehicle. The vehicle may be vehicle 102 described above in connection with FIG. 2 where controller 22 is configured to execute procedure 300. Procedure 300 may also be utilized in connection with other vehicle systems and controllers including, for example, the alternatives and additions described herein, such as vehicles without an engine. The cooling system may be electrically driven cooling system 10 or the combined cooling systems of cooling system 100 described above in connection with FIG. 1 or 2, or other cooling systems including, for example, the alternatives and additions described herein.

Procedure 300 begins at operation 302 with operating an engine of a vehicle. Procedure 300 continues at operation 304 to cool the engine with a mechanically driven cooling system, such as cooling system 120 discussed above. In embodiments of a vehicle without an engine, operations 302 and 304 are omitted and procedure 300 begins at operation 306.

Procedure 300 continues at operation 306 with determining a temperature condition of one or more non-engine components of the vehicle. As discussed above, non-engine components can include electric power components, mechanical components, or energy storage components in which cooling is required or desirable to maintain temperature conditions to reduce heat soak and improve durability and operating life. Procedure 300 continues at conditional 308 to determine if the temperature condition is above a temperature condition threshold. If conditional 306 is YES, procedure 300 continues at operation 310 to cool the non-engine components with an electrically driven cooling system.

In certain embodiments in which the vehicle includes a motor/generator and regenerative braking capabilities, procedure 300 can further include an operation to store electrical energy from regenerative braking with the electrically driven cooling system. For example, even if the temperature condition of the one or more non-engine components is less than the temperature condition threshold, procedure 300 can include an operation to pre-cool the one or more non-engine components with energy from regenerative braking to delay future cooling requirements by making use of the free energy available from regenerative braking. The regenerative braking energy can be used by one or both of the electrically driven coolant pump and radiator fan, by turning one or both ON when in an OFF state, by maintaining one or both in an ON state when otherwise a change to an OFF state would be made, or by increasing a speed of one or both the coolant pump and fan to increase the amount of cooling that is provided. In a further embodiment, the use of the regenerative braking energy for pre-cooling is performed after determining a state of charge of an energy storage source is above a predetermined threshold, prioritizing the use of the regenerative braking energy for charging of the energy storage source before using the regenerative braking energy for pre-cooling of non-engine components.

Procedure 300 may further include operations to perform one or more tests and valve control operations to confirm that one or more controllable valves in the coolant flowpath(s) are positioned appropriately for the current operating state of the system and/or command any required adjustments or setting of the controllable valves. The valve control operations may include tests of engine operation, coolant temperature, and temperature of one or more non-engine n components and commands to adjust valves to direct coolant flow to the engine, or to one or more flowpath portions of the electrically driven cooling system.

Figure 4:
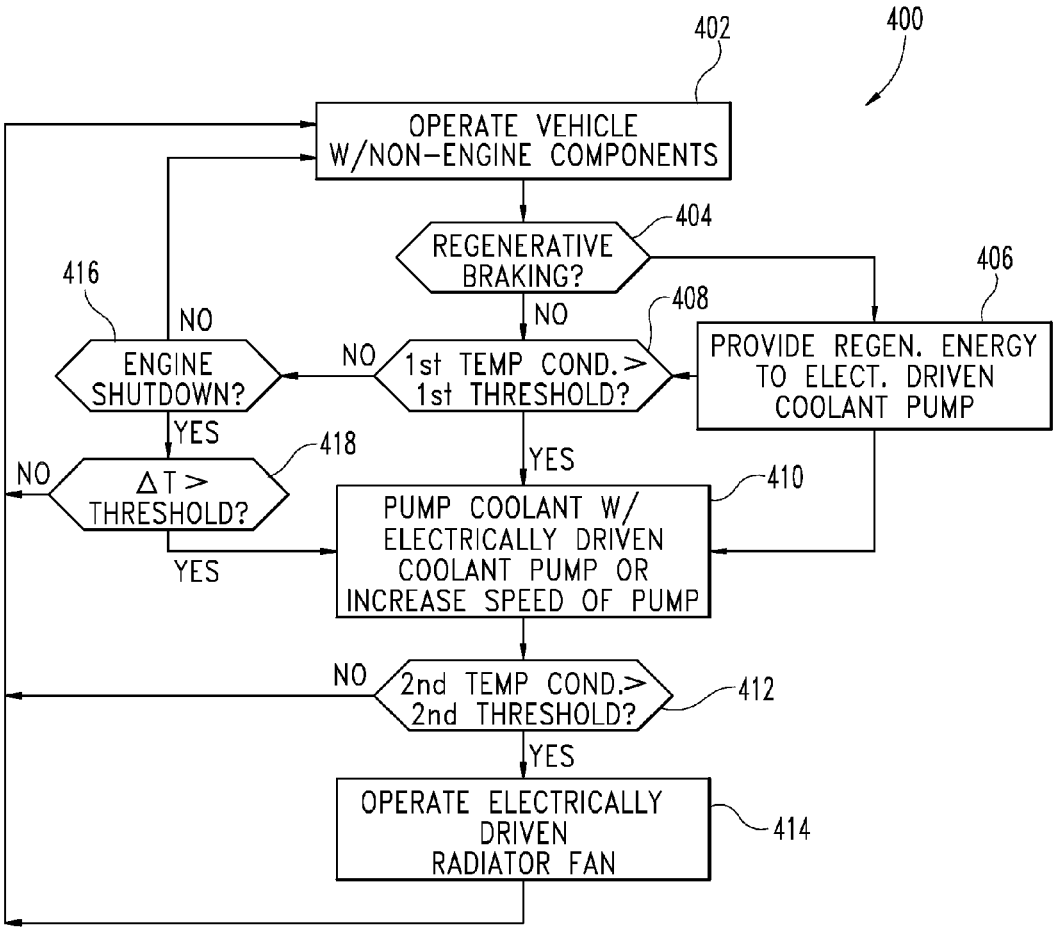
FIG. 4 is a flow diagram illustrating another exemplary control procedure for an electrically driven cooling system.

In another embodiment, a procedure 400 is illustrated in FIG. 4. Procedure 400 includes an operation 402 to operate the vehicle with the plurality of non-engine components. Procedure 400 continues at conditional 404 in which it is determined whether a regenerative braking condition is present. If conditional 404 is negative, procedure 400 continues at operation 406 to provide regenerative braking energy to the electrically driven coolant pump. Procedure 400 continues at operation 410 to pump coolant with the electrically driven coolant pump, or to increase the speed of the electrically driven coolant pump, utilizing the energy from the regenerative braking condition. In one embodiment, the operation of the electrically driven coolant pump occurs without regard to the temperature condition of the non-engine components to utilize free pre-cooling opportunities. In other embodiments, cooling with regenerative braking energy is controlled to occur in response to certain temperature conditions, state of charge conditions of the energy storage device(s), or other parameters.

If conditional 404 is negative, procedure 400 continues at conditional 408 to determine if a first temperature condition associated with the one or more of the non-engine components is greater than a first temperature threshold. If conditional 408 is positive, procedure 400 continues at operation 410 to pump coolant with the electrically driven coolant pump in the closed loop coolant flowpath that connects the non-engine components to provide cooling. The coolant pump can be driven with energy from the electrical energy storage source and/or from regenerative braking if available. From operation 410, procedure 400 continues at conditional 412 to determine if a second temperature condition of the non-engine components is greater than a second temperature threshold. If the conditional 412 is positive, then procedure 400 continues at operation 414 to operate the electrically driven radiator fan across the radiator in the coolant flow path to provide additional cooling. Procedure 400 returns from operation 414 to operation 402 to continue vehicle operations and monitoring of temperature conditions.

Referring back to conditional 408, if conditional 408 is negative, procedure 400 continues at conditional 416 to determine if an engine shutdown condition exists. If conditional 416 is negative, procedure 400 returns to operation 402. If conditional 416 is positive, procedure 400 continues at conditional 418 to determine if a change in temperature $\Delta T$ for one or more of the non-engine components is greater than a temperature increase threshold. If conditional 418 is negative, then procedure 400 continues at operation 402. If conditional 418 is positive, procedure 400 continues at operation 410 to provide coolant circulation with the electrically driven coolant pump to reduce the temperature of the non-engine components after engine shutdown.

The rate of coolant flow provided by the electrically driven coolant pump 20 may be controlled based upon the temperature of one or more non-engine components 14, the coolant temperature, or other variables to provide coolant flow effective to provide the desired cooling of the non-engine components which are cooled by the electrically driven cooling system.

Various aspects of the present disclosure are contemplated. For example, in one aspect a cooling system for a vehicle includes an electrical power source including an energy storage device. Some exemplary embodiments include a vehicle cooling system including a closed loop coolant flowpath including an electrically driven coolant pump connected to the electrical power source and a radiator. The electrically driven coolant pump is operable to circulate a coolant through the closed loop coolant flowpath through the radiator. The closed loop coolant flowpath further is in flow communication with a plurality of non-engine components of the vehicle to receive coolant circulated by the electrically driven coolant pump and provide the coolant to the radiator. The system also includes an electrically driven radiator fan connected to the electrical power source that is operable to push air across the radiator.

In one embodiment, the vehicle cooling system includes a controller configured to control the electrically driven coolant pump to operate independently of an engine of the vehicle in response to a temperature condition of at least one of the plurality of components. In a refinement of this embodiment, the controller is operable to increase a speed of the electrically driven coolant pump in response to a demand for increased coolant flow in the closed loop coolant flowpath. In another refinement, the controller is configured to operate the electrically driven coolant pump in response to a regenerative braking mode of operation of the vehicle. In a further refinement, the controller is configured to operate the electrically driven coolant pump in the regenerative braking mode of operation in response to a state of charge of an energy storage source of the vehicle being at or above an upper threshold.

In another embodiment, at least a portion of the plurality of non-engine components are connected in series in the closed loop coolant flowpath. In a refinement of this embodiment, at least a second portion of the plurality of non-engine components are connected in parallel in the closed loop coolant flowpath.

In another embodiment, at least a portion of the plurality of non-engine components are connected in parallel in the closed loop coolant flowpath. In a further embodiment, the plurality of non-engine components include at least one of a turbocharger, an air compressor, and an exhaust gas recirculation valve, and at least one of power electronics, a DC/AC inverter, a DC/DC converter, and an energy storage source. In a further refinement, the plurality of non-engine components includes a motor/generator. In a further refinement, the motor-generator, the at least one of the turbocharger, air compressor and exhaust gas recirculation valve, and the at least one of the power electronics, DC/AC inverter, DC/DC converter, and energy storage source are each located on separate portions of the closed loop coolant flowpath that are hydraulically isolatable from the other portions.

In another embodiment, the vehicle cooling system includes an engine and a second closed loop coolant flowpath including a mechanically driven coolant pump for circulating coolant to the engine and through a second radiator. In a refinement of this embodiment, the second closed loop coolant flowpath is flow isolated from the coolant flowpath connected to the electrically driven coolant pump.

In another exemplary embodiment, a method includes operating a vehicle including a plurality of non-engine components; determining a temperature condition of at least one of the plurality of non-engine components; in response to the temperature condition being above a first threshold, pumping coolant through a closed loop coolant flowpath in thermal communication with at least a portion of the plurality of non-engine components with an electrically driven coolant pump; determining a temperature condition of the coolant; and in response to the temperature condition of the coolant being above a second threshold, operating an electrically driven radiator fan to remove heat from the coolant at a radiator connected to the closed loop coolant flowpath.

In one embodiment, the vehicle includes an engine and the method includes pumping coolant through a second closed loop flowpath in thermal communication with an engine of the vehicle with a mechanically driven component in response to operating the engine. In a refinement of this embodiment, the method includes circulating coolant in the second closed loop flowpath through a second radiator and cooling the coolant in the second radiator with a second radiator fan. In another refinement, the method includes operating the electrically driven coolant pump when the engine is shut down.

In another embodiment, the method includes determining a regenerative braking condition of the vehicle and operating the electrically driven coolant pump with energy from the regenerative braking condition. In a refinement of this embodiment, the method includes increasing a speed of the electrically driven coolant pump and/or electrically driven radiator fan in response to the regenerative braking condition. In another refinement, the method includes operating the electrically driven coolant pump and/or the electrically driven radiator fan in response to the regenerative braking condition when the temperature condition of the at least one non-engine component is below the first threshold.

In another embodiment, the method includes shutting down an engine of the vehicle; determining an increase in the first temperature condition associated with the at least one of the plurality of non-engine components after shutting down the engine; and in response to the increase in the first temperature condition, increasing the flow rate of the coolant with the electrically driven coolant pump.

According to another aspect, a vehicle cooling system is provided that includes a first closed loop coolant flowpath connecting an engine, a first radiator, and a mechanically driven coolant pump. The mechanically driven coolant pump is operable to circulate a first coolant through the first closed loop coolant flowpath, and the first closed loop coolant flowpath is in flow communication with the engine and the first radiator. The system includes a second closed loop coolant flowpath that is flow isolated from the first closed loop coolant flowpath. The second closed loop coolant flowpath connects an electrically driven coolant pump and a second radiator. The electrically driven coolant pump is connected to an electrical energy storage device and is operable with power therefrom to circulate a second coolant through the second closedloop coolant flowpath through the second radiator. The second closed loop coolant flowpath further is in flow communication with a plurality of non-engine components of the vehicle that receive the second coolant circulated by the electrically driven coolant pump and provide the second coolant to the second radiator. The system includes an electrically driven radiator fan operable to push air across the second radiator and a controller configured to operate the electrically driven coolant pump and the electrically driven radiator fan in response to shutdownof the engine to provide cooling of the plurality of non-engine components with the second coolant while the engine is shutdown.

In one embodiment, the plurality of non-engine components include at least two of anelectric generator, a motor, an energy storage source, power electronics, an AC/DC inverter, anda DC/DC converter. In a refinement of this embodiment, the plurality of non-engine components includes an air compressor. In a further refinement, the plurality of non-engine components includes at least one of an exhaust gas recirculation valve and a turbocharger.

In another embodiment, the controller is configured to operate the electrically driven coolant pump and the electrically driven radiator fan independently of a speed of the engine. In a refinement of this embodiment, the controller is configured increase a speed of the electrically driven coolant pump to increase a flow rate of the second coolant in the second closed loop coolant flowpath in response to an increase of a temperature of the plurality of non-engine components after shutdown of the engine.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the invention are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A vehicle cooling system comprising:

a closed loop coolant flowpath connecting an electrically driven coolant pump and a radiator, the electrically driven coolant pump operable to circulate coolant through the closed loop coolant flowpath through the radiator, the closed loop coolant flowpath further being in flow communication with a plurality of non-engine components of the vehicle to receive coolant circulated by the electrically driven coolant pump and provide the coolant to the radiator;

an electrically driven radiator fan operable to push air across the radiator; and a controller configured to control the electrically driven coolant pump and the electrically driven radiator fan to operate independently of an operating condition of an engine of the vehicle in response to a temperature condition of at least one of the plurality of non-engine components, wherein the controller is further operable to increase a speed of at least one of the electrically driven coolant pump and the electrically driven radiator fan in response to a demand for increased coolant flow in the closed loop coolant flowpath.

2. The vehicle cooling system according to claim 1, wherein the controller is configured to operate the electrically driven coolant pump in response to a regenerative braking mode of operation of the vehicle.

3. The vehicle cooling system according to claim 2, wherein the controller is further configured to operate the electrically driven coolant pump in the regenerative braking mode of operation in response to a state of charge of an energy storage source of the vehicle being at or above an upper threshold.

4. The vehicle cooling system according to claim 1, wherein at least a portion of the plurality of non-engine components are connected in series in the closed loop coolant flowpath.

5. The vehicle cooling system according to claim 4, wherein at least a second portion of the plurality of non-engine components are connected in parallel in the closed loop coolant flowpath.

6. The vehicle cooling system according to claim 1, wherein at least a portion of the plurality of non-engine components are connected in parallel in the closed loop coolant flowpath.

7. The vehicle cooling system according to claim 1, wherein the plurality of non-engine components include at least one a turbocharger, an air compressor, an exhaust gas recirculation valve, and least one of power electronics, a DC/AC inverter, a DC/DC converter, and an energy storage source.

8. The vehicle cooling system according to claim 1, further comprising an engine and a second closed loop coolant flowpath including a mechanically driven coolant pump for circulating coolant to the engine and through a second radiator.

9. The vehicle cooling system according to claim 8, wherein the second closed loop coolant flowpath is flow isolated from the coolant flowpath connected to the electrically driven coolant pump.

10. The vehicle cooling system according to claim 1, wherein the engine operating condition includes an engine speed.

11. The vehicle cooling system according to claim 1, wherein the engine operating condition includes the engine being shut down.

12. The vehicle cooling system according to claim 1, wherein the engine operating condition includes the engine being in a running mode of operation.

13. A method comprising:

operating a vehicle including a plurality of non-engine components, the vehicle further including an engine;

determining a temperature condition of at least one of the plurality of non-engine components;

in response to the temperature condition being above a first threshold, pumping coolant through a closed loop coolant flowpath in thermal communication with at least a portion of the plurality of non-engine components with an electrically driven coolant pump;

determining a temperature condition of the coolant;

in response to the temperature condition of the coolant being above a second threshold, operating an electrically driven radiator fan to remove heat from the coolant at a radiator connected to the closed loop coolant flowpath; and pumping coolant through a second closed loop coolant flowpath in thermal communication with the engine with a mechanically driven component in response to operating the engine.

14. The method according to claim 13, further comprising circulating coolant in the second closed loop coolant flowpath through a second radiator and cooling the coolant in the second radiator with a second radiator fan.

15. The method according to claim 13, further comprising operating the electrically driven coolant pump when the engine is shut down.

16. The method according to claim 13, further comprising:

determining a regenerative braking condition of the vehicle; and operating the electrically driven coolant pump with energy from the regenerative braking condition.

17. The method according to claim 16, further comprising increasing a speed of the electrically driven coolant pump in response to the regenerative braking condition.

18. The method according to claim 16, further comprising operating the electrically driven coolant pump in response to the regenerative braking condition when the temperature condition of the at least one non-engine component is below the first threshold.

* * * * *